US007192084B1

(12) United States Patent
Huang

(10) Patent No.: US 7,192,084 B1
(45) Date of Patent: Mar. 20, 2007

(54) INTEGRALLY FORMED TABLE AND CHAIR ASSEMBLY

(76) Inventor: Jia-Xiong Huang, 433, Jia Tian Rd., Ho Mei Chen, Changhua Hsien (TW)

( * ) Notice: Subject to any disclaimer, the term of this patent is extended or adjusted under 35 U.S.C. 154(b) by 0 days.

(21) Appl. No.: 11/389,681

(22) Filed: Mar. 27, 2006

(30) Foreign Application Priority Data

Aug. 31, 2005 (TW) ..... 94215011 A

(51) Int. Cl.
*A47C 83/02* (2006.01)

(52) U.S. Cl. ..... 297/172; 297/143; 297/174

(58) Field of Classification Search ..... 297/170, 297/172, 174, 143
See application file for complete search history.

(56) References Cited

U.S. PATENT DOCUMENTS 759,289 A * 5/1904 Leland ..... 297/172
1,314,240 A * 8/1919 Besner et al. ..... 297/143
2,673,595 A * 3/1954 Kump, Jr. ..... 297/172
4,560,200 A * 12/1985 Giannelli et al. ..... 297/172
4,798,411 A * 1/1989 Lin ..... 297/170
5,414,949 A * 5/1995 Peebles ..... 42/94
5,697,668 A * 12/1997 Chao ..... 297/172
6,227,614 B1 * 5/2001 Rubin ..... 297/172
6,269,578 B1 * 8/2001 Callegari ..... 297/172
2005/0099040 A1 * 5/2005 Mills et al. ..... 297/170

* cited by examiner

*Primary Examiner*—Peter R. Brown
(74) *Attorney, Agent, or Firm*—Alan D. Kamrath; Nikolai & Mersereau, P.A.

(57) ABSTRACT

A table and chair assembly includes a base frame, a table mounted on the base frame, a support member adjustably mounted on the base frame and movable relative to the table, and a chair mounted on the support member to move therewith. Thus, the support member is movable on the base frame after the support member is unlocked from the base frame so that the chair is movable relative to the table to adjust the relative position between the chair and the table so as to satisfy a user's stature. In addition, the support member is locked on and unlocked from the base frame easily and quickly by operation of the locking devices, thereby facilitating the user adjusting the relative position between the chair and the table.

16 Claims, 6 Drawing Sheets

INTEGRALLY FORMED TABLE AND CHAIR ASSEMBLY

BACKGROUND OF THE INVENTION

1. Field of the Invention

The present invention relates to a table and chair assembly and, more particularly, to an integrally formed table and chair assembly.

2. Description of the Related Art

A conventional table and chair assembly comprises a base frame, a table mounted on a first end of the base frame, and a chair mounted on a second end of the base frame. Thus, the table and chair assembly provides the table and the chair for use with a user. However, the table and the chair are fixed on the base frame so that the relative position between the chair and the table is fixed and cannot be adjusted freely to satisfy a user's stature and requirement, thereby causing inconvenience to the user.

BRIEF SUMMARY OF THE INVENTION

In accordance with the present invention, there is provided a table and chair assembly, comprising a base frame, a table mounted on the base frame, a support member adjustably mounted on the base frame and movable relative to the table, and a chair mounted on the support member to move therewith.

The primary objective of the present invention is to provide an integrally formed table and chair assembly.

Another objective of the present invention is to provide a table and chair assembly having a position adjustable function.

A further objective of the present invention is to provide a table and chair assembly, wherein the support member is movable on the base frame after the support member is unlocked from the base frame so that the chair is movable relative to the table to adjust the relative position between the chair and the table so as to satisfy a user's stature and requirement.

A further objective of the present invention is to provide a table and chair assembly, wherein the support member is used individually, thereby enhancing the versatility of the support member.

A further objective of the present invention is to provide a table and chair assembly, wherein the support member is locked on and unlocked from the base frame easily and quickly by operation of the locking devices, thereby facilitating the user adjusting the relative position between the chair and the table.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
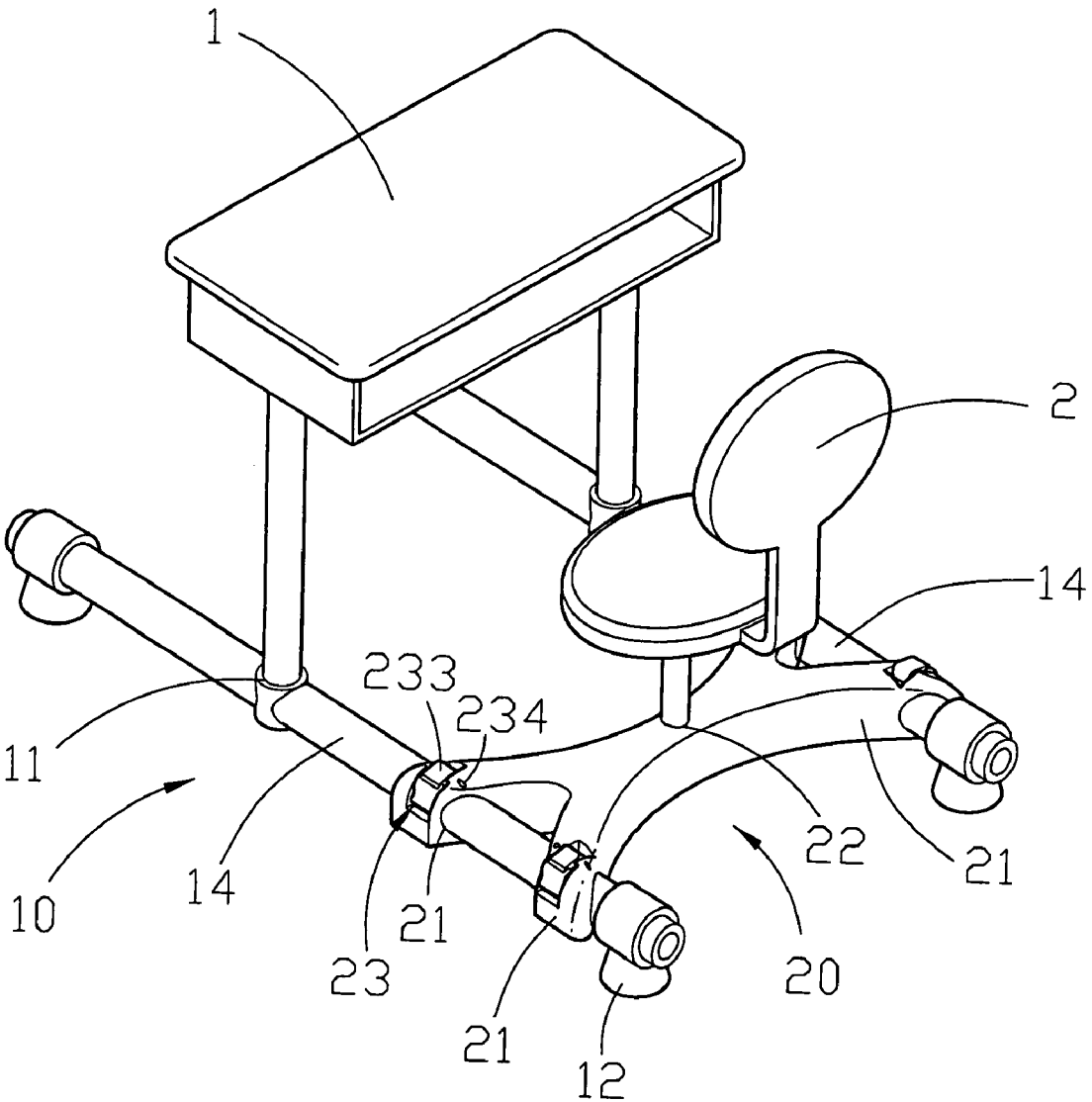
FIG. 1 is a perspective view of a table and chair assembly in accordance with the preferred embodiment of the present invention.
Figure 2:
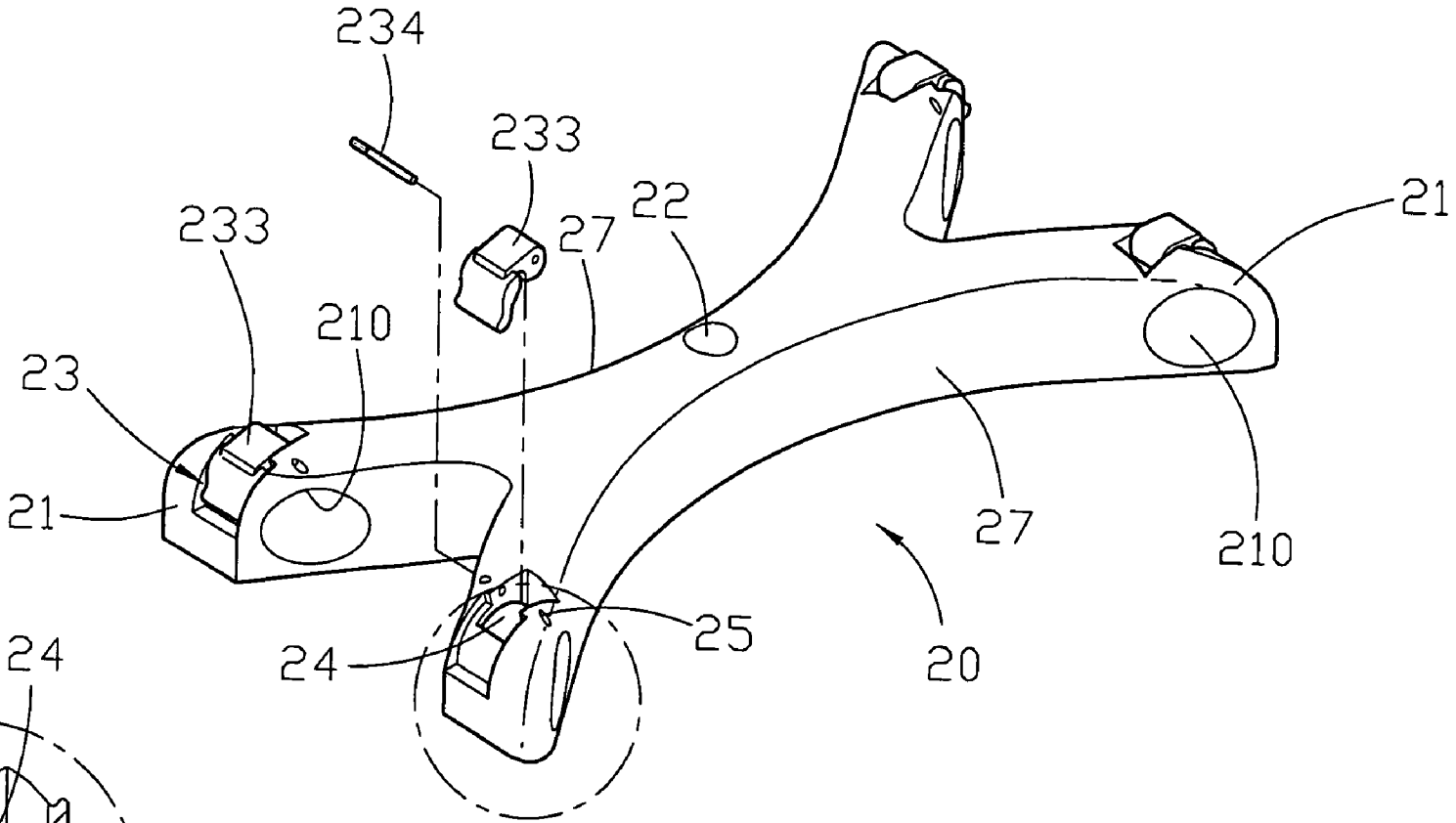
FIG. 2 is a partially exploded perspective view of the table and chair assembly as shown in FIG. 1.
Figure 3:
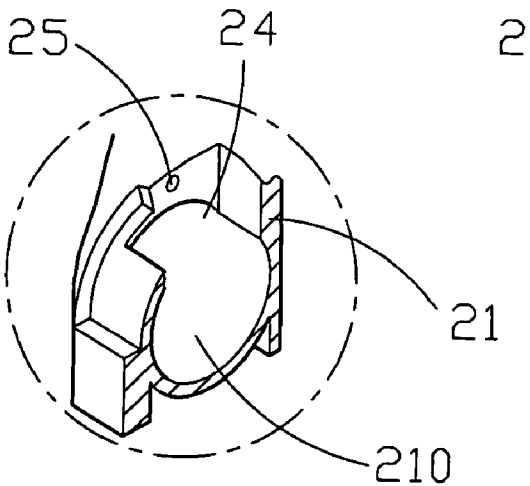
FIG. 3 is a locally enlarged perspective cross-sectional view of the table and chair assembly as shown in FIG. 2.

Referring to the drawings and initially to FIGS. 1–3, a table and chair assembly in accordance with the preferred embodiment of the present invention comprises a base frame 10, a table 1 mounted on the base frame 10, a support member 20 adjustably mounted on the base frame 10 and movable relative to the table 1, and a chair 2 mounted on the support member 20 to move therewith.

The base frame 10 has an integrally formed construction and includes two parallel support tubes 14 to support the table 1 and the support member 20. Each of the support tubes 14 of the base frame 10 has a mediate portion formed with a mounting hole 11 for mounting the table 1 and two end portions each provided with a foot pad 12.

The support member 20 has two opposite concave sides 27. The support member 20 has a mediate portion formed with a mounting hole 22 for mounting the chair 2 and two opposite end portions 21 each movably mounted on a respective one of the support tubes 14 of the base frame 10. Each of the end portions 21 of the support member 20 is substantially V-shaped and has two spaced sides each formed with a receiving chamber 24 for mounting a locking device 23 and a through hole 210 connected to the receiving chamber 24 and movably mounted on the respective support tube 14 of the base frame 10. The receiving chamber 24 of each of the end portions 21 of the support member 20 has two opposite sides each formed with a pin hole 25.

The locking device 23 is urged on the respective support tube 14 of the base frame 10 to lock each of the end portions 21 of the support member 20 on the respective support tube 14 of the base frame 10. The locking device 23 includes a locking member 233 pivotally mounted in the receiving chamber 24 of each of the end portions 21 of the support member 20 and releasably locked on the respective support tube 14 of the base frame 10, and a pivot pin 234 extended through each of the end portions 21 of the support member 20 and the locking member 233 so that the locking member 233 is pivotally mounted on the pivot pin 234. The pivot pin 234 of the locking device 23 has two ends each inserted into the respective pin hole 25 of each of the end portions 21 of the support member 20 so that the pivot pin 234 is secured in the receiving chamber 24 of each of the end portions 21 of the support member 20.

Figure 4:
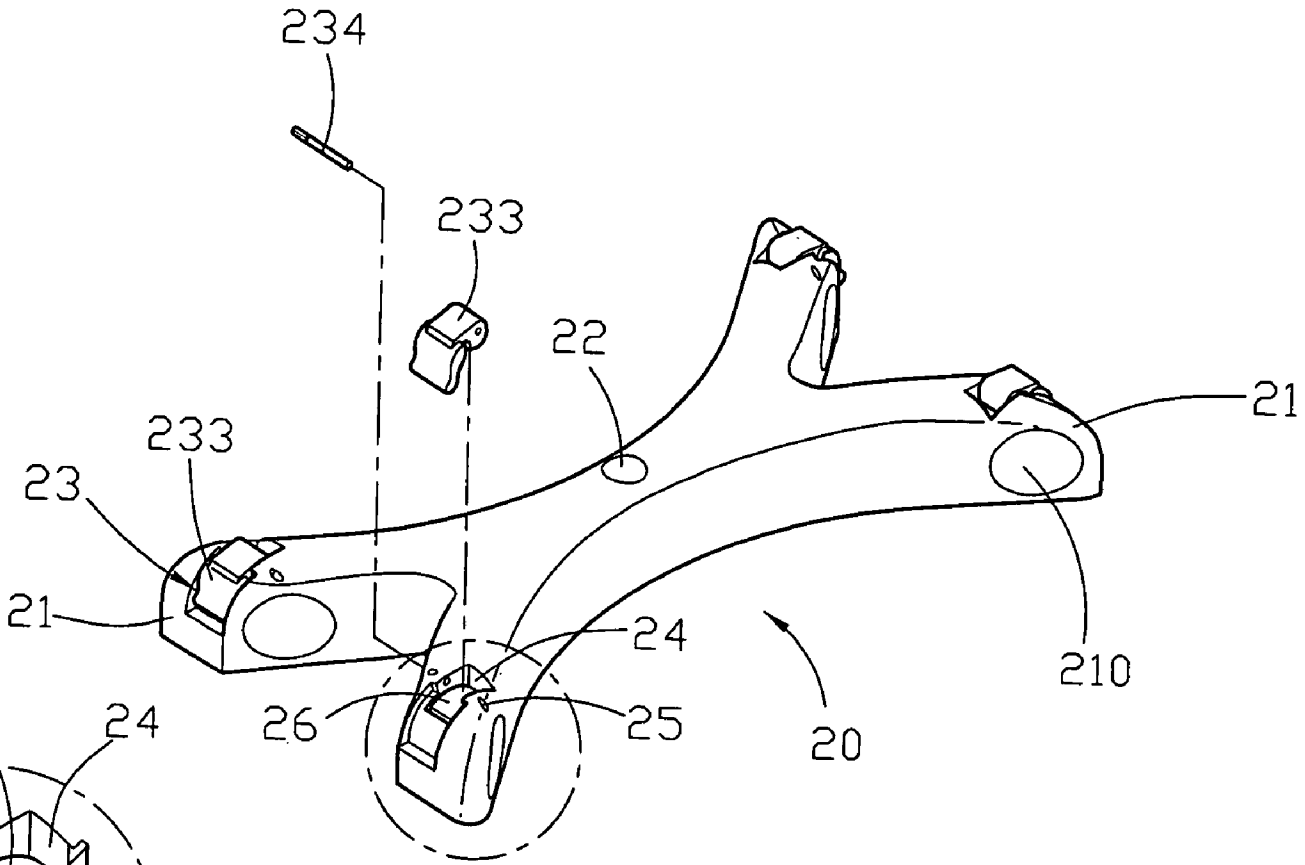
FIG. 4 is a partially exploded perspective view of a table and chair assembly in accordance with another preferred embodiment of the present invention.
Figure 5:
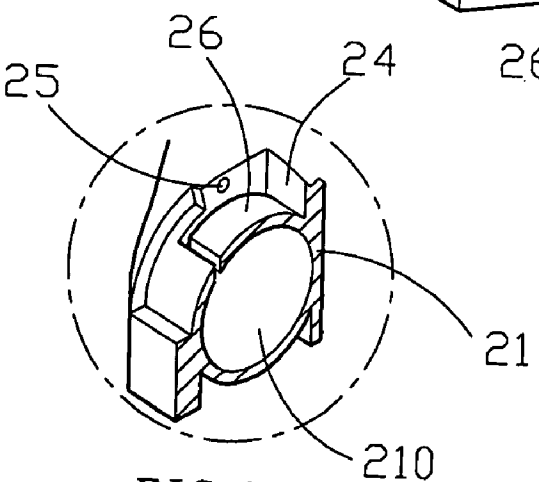
FIG. 5 is a locally enlarged perspective cross-sectional view of the table and chair assembly as shown in FIG. 4.

Referring to FIGS. 4 and 5 with reference to FIG. 1, the receiving chamber 24 of each of the end portions 21 of the support member 20 is provided with a substantially arc-shaped flexible pressing plate 26 detachably rested on the respective support tube 14 of the base frame 10, and the locking member 233 of the locking device 23 is rested on the pressing plate 26 to push the pressing plate 26 toward the respective support tube 14 of the base frame 10.

As shown in FIG. 1, the locking member 233 of each of the locking devices 23 is locked on the respective support tube 14 of the base frame 10 to lock each of the end portions 21 of the support member 20 on the respective support tube 14 of the base frame 10 so that the support member 20 is fixed on the base frame 10 by the locking devices 23.

Figure 6:
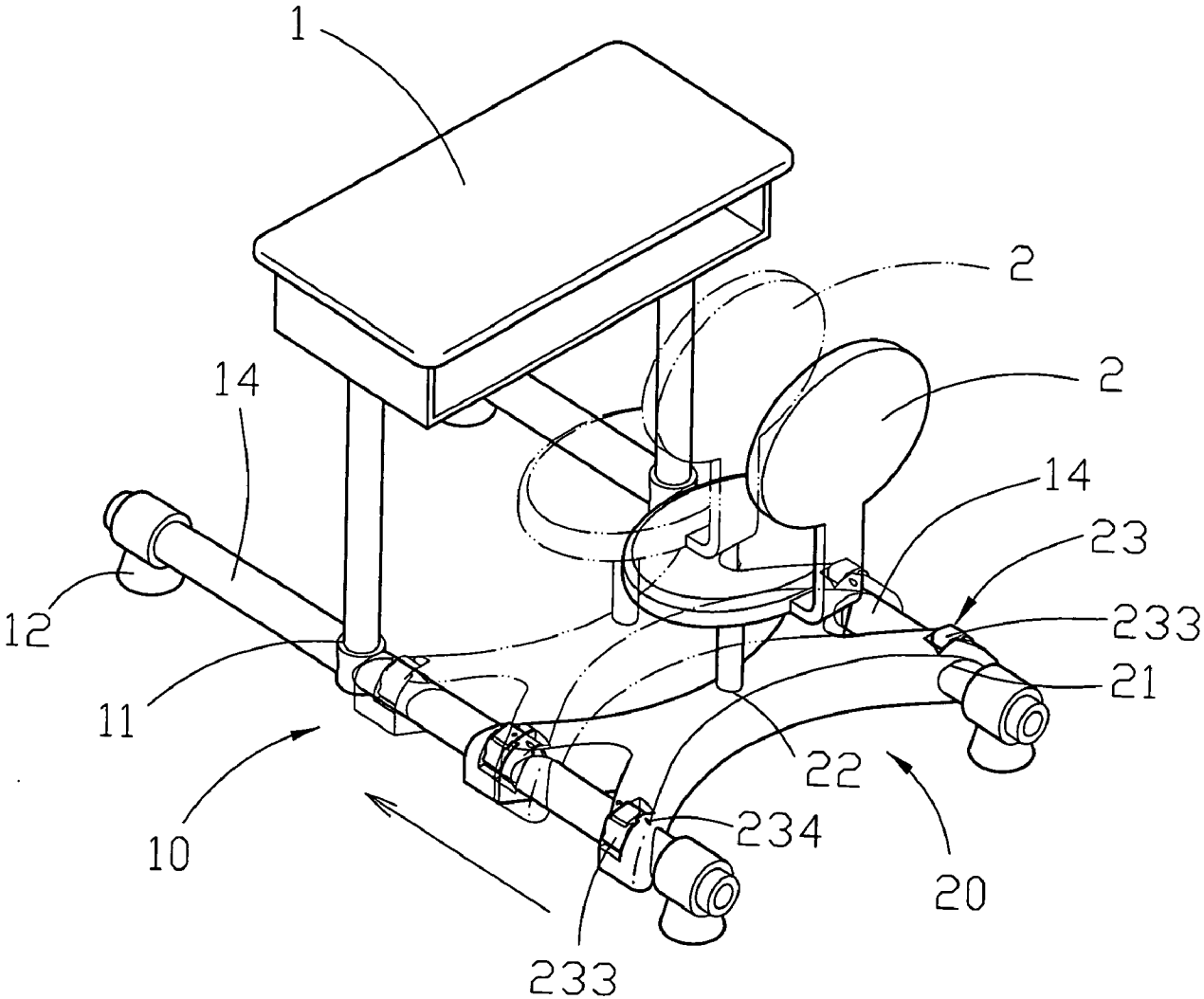
FIG. 6 is a schematic operational view of the table and chair assembly as shown in FIG. 1.

Referring to FIG. 6, the locking member 233 of each of the locking devices 23 is unlocked from the respective support tube 14 of the base frame 10 to unlock each of the end portions 21 of the support member 20 from the respective support tube 14 of the base frame 10 so that the support member 20 is released from the base frame 10. Thus, the support member 20 is movable on the base frame 10 after each of the end portions 21 of the support member 20 is unlocked from the respective support tube 14 of the base frame 10 so that the chair 2 is movable relative to the table 1 so as to adjust a relative position between the chair 2 and the table 1.

Figure 7:
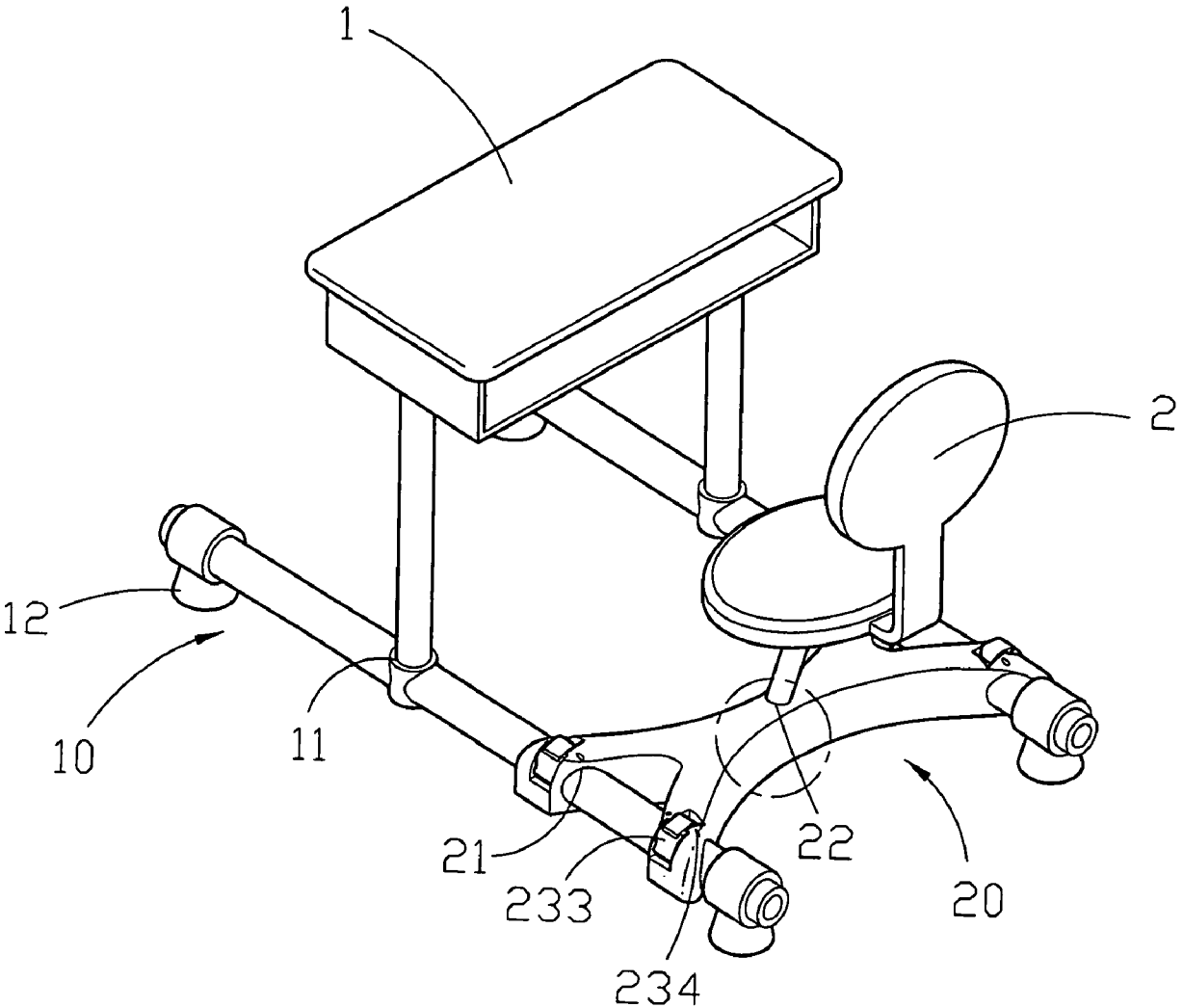
FIG. 7 is a perspective view of a table and chair assembly in accordance with the preferred embodiment of the present invention.
Figure 8:
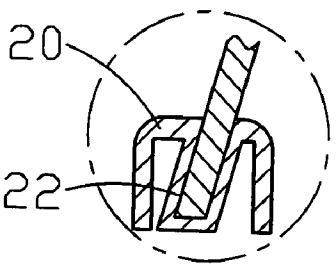
FIG. 8 is a locally enlarged perspective cross-sectional view of the table and chair assembly as shown in FIG. 7.

Referring to FIGS. 7 and 8, the mounting hole 22 of the support member 20 is arranged in an oblique manner.

Figure 9:
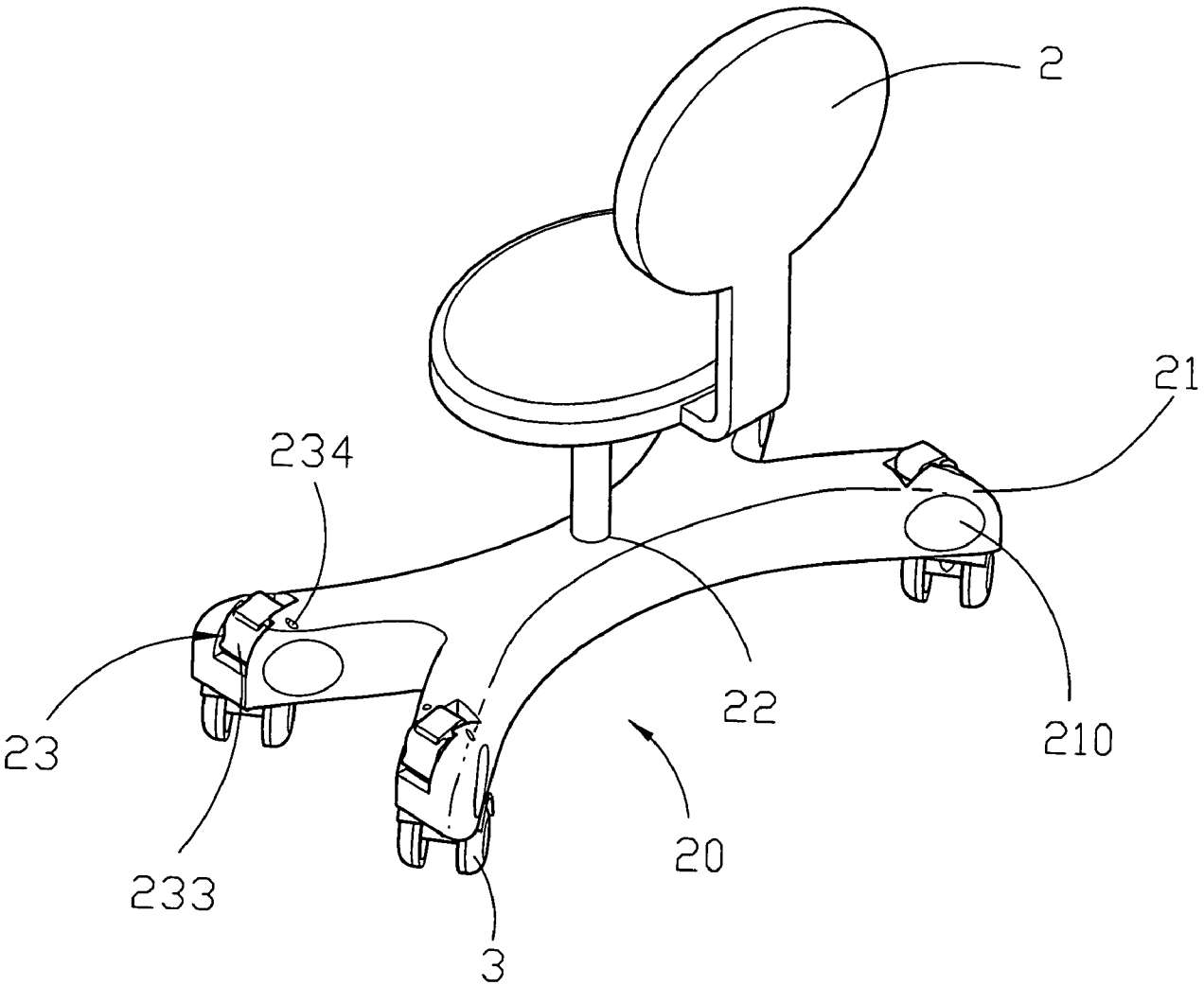
FIG. 9 is a perspective view of a table and chair assembly in accordance with the preferred embodiment of the present invention.

Referring to FIG. 9, the support member 20 is used individually and has a bottom provided with a plurality of castors 3.

Accordingly, the support member 20 is movable on the base frame 10 after the support member 20 is unlocked from the base frame 10 so that the chair 2 is movable relative to the table 1 to adjust the relative position between the chair 2 and the table 1 so as to satisfy a user's stature and requirement. In addition, the support member 20 is used individually, thereby enhancing the versatility of the support member 20. Further, the support member 20 is locked on and unlocked from the base frame 10 easily and quickly by operation of the locking devices 23, thereby facilitating the user adjusting the relative position between the chair 2 and the table 1.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A table and chair assembly, comprising:

a base frame;

a table mounted on the base frame;

a support member adjustably mounted on the base frame and movable relative to the table;

a chair mounted on the support member to move therewith;

wherein the base frame includes two parallel support tubes to support the table and the support member;

the support member has two opposite end portions each movably mounted on a respective one of the support tubes of the base frame;

each of the end portions of the support member has two spaced sides each formed with a receiving chamber for mounting a locking device;

the locking device includes a locking member pivotally mounted in the receiving chamber of each of the end portions of the support member and releasably locked on the respective support tube of the base frame.

2. The table and chair assembly in accordance with claim 1, wherein each of the support tubes of the base frame has a mediate portion formed with a mounting hole for mounting the table.

3. The table and chair assembly in accordance with claim 1, wherein each of the support tubes of the base frame has two end portions each provided with a foot pad.

4. The table and chair assembly in accordance with claim 1, wherein the support member has two opposite concave sides.

5. The table and chair assembly in accordance with claim 1, wherein each of the end portions of the support member is substantially V-shaped.

6. The table and chair assembly in accordance with claim 1, wherein each of the two spaced sides of each of the end portions of the support member is formed with a through hole connected to the receiving chamber and movably mounted on the respective support tube of the base frame.

7. The table and chair assembly in accordance with claim 1, wherein the locking device is urged on the respective support tube of the base frame to lock each of the end portions of the support member on the respective support tube of the base frame.

8. The table and chair assembly in accordance with claim 1, wherein the locking device further includes a pivot pin extended through each of the end portions of the support member and the locking member so that the locking member is pivotally mounted on the pivot pin.

9. The table and chair assembly in accordance with claim 8, wherein the receiving chamber of each of the end portions of the support member has two opposite sides each formed with a pin hole, and the pivot pin of the locking device has two ends each inserted into the respective pin hole of each of the end portions of the support member so that the pivot pin is secured in the receiving chamber of each of the end portions of the support member.

10. The table and chair assembly in accordance with claim 1, wherein the receiving chamber of each of the end portions of the support member is provided with a pressing plate detachably rested on the respective support tube of the base frame, and the locking member of the locking device is rested on the pressing plate to push the pressing plate toward the respective support tube of the base frame.

11. The table and chair assembly in accordance with claim 10, wherein the pressing plate of each of the end portions of the support member is a substantially arc-shaped flexible body.

12. The table and chair assembly in accordance with claim 1, wherein the support member is movable on the base frame after each of the end portions of the support member is unlocked from the respective support tube of the base frame so that the chair is movable relative to the table so as to adjust a relative position between the chair and the table.

13. The table and chair assembly in accordance with claim 1, wherein the support member has a mediate portion formed with a mounting hole for mounting the chair.

14. The table and chair assembly in accordance with claim 13, wherein the mounting hole of the support member is arranged in an oblique manner.

15. The table and chair assembly in accordance with claim 1, wherein the support member is used individually.

16. The table and chair assembly in accordance with claim 1, wherein the support member has a bottom provided with a plurality of castors.

* * * * *